US008917225B2

(12) United States Patent
Kang et al.

(10) Patent No.: US 8,917,225 B2
(45) Date of Patent: Dec. 23, 2014

(54) PIXEL CIRCUIT, AND ORGANIC LIGHT EMITTING DISPLAY, AND DRIVING METHOD THEREOF

(75) Inventors: Chul-Kyu Kang, Yongin (KR); Sang-Moo Choi, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 620 days.

(21) Appl. No.: 12/914,924

(22) Filed: Oct. 28, 2010

(65) Prior Publication Data

US 2011/0164018 A1 Jul. 7, 2011

(30) Foreign Application Priority Data

Jan. 5, 2010 (KR) ..... 10-2010-0000570

(51) Int. Cl.
*G09G 3/32* (2006.01)

(52) U.S. Cl.
CPC ..... *G09G 3/3233* (2013.01); *G09G 2300/0861* (2013.01); *G09G 2300/0852* (2013.01); *G09G 2300/0819* (2013.01)
USPC ..... 345/82; 315/169.3; 345/211

(58) Field of Classification Search
USPC ..... 345/76–83, 204, 690, 211; 315/169.3
See application file for complete search history.

(56) References Cited

U.S. PATENT DOCUMENTS

2007/0063932 A1* 3/2007 Nathan et al. ..... 345/76
2007/0132694 A1* 6/2007 Uchino et al. ..... 345/92
2008/0291138 A1 11/2008 Yamashita et al.
2009/0231308 A1* 9/2009 Numao ..... 345/204
2010/0309187 A1 12/2010 Kang et al.

FOREIGN PATENT DOCUMENTS

| | | | |
|---|---|---|---|
| JP | 2008-096962 | | 4/2008 |
| KR | 10-2002-0010455 | A | 2/2002 |
| KR | 10-2005-0109167 | | 11/2005 |
| KR | 10-2006-0001745 | A | 1/2006 |
| KR | 10-2006-0024869 | | 3/2006 |
| KR | 10-2008-0083137 | A | 9/2008 |
| KR | 10-2008-0102955 | | 11/2008 |
| KR | 10-2010-0131118 | | 12/2010 |
| WO | WO 2006103797 | A1 * | 10/2006 |

OTHER PUBLICATIONS

KIPO Notice of Allowance dated Jan. 19, 2012, for corresponding Korean Patent Application No. 10-2010-0000570, listing the Foreign References cited above, 5 pages.

* cited by examiner

*Primary Examiner* — Stephen Sherman
(74) *Attorney, Agent, or Firm* — Christie, Parker & Hale, LLP

(57) ABSTRACT

A pixel circuit including an organic light emitting diode. Also, the pixel circuit includes: a second transistor connected to a first scanning line, a data line, and a first node; a fifth transistor connected to a third scanning line, the first node, and a second node; a fourth transistor connected to a second scanning line, a first reference voltage, and the second node; a third transistor connected to the first scanning line, a second reference voltage, and a third node; a first capacitor connected between the first node and the second node; a second capacitor connected between the second node and the third node; and a first transistor connected to the first node, a first power, and the third node, and configured to drive the organic light emitting diode.

21 Claims, 8 Drawing Sheets

① INITIALIZATION SECTION

② DATA WRITE AND Vth COMPENSATION SECTION

③ LIGHT EMITTING SECTION

① DATA WRITE AND INITIALIZATION SECTION

② Vth COMPENSATION SECTION

③ LIGHT EMITTING SECTION

① DATA WRITE AND INITIALIZATION SECTION

② Vth COMPENSATION SECTION

③ LIGHT EMITTING SECTION

PIXEL CIRCUIT, AND ORGANIC LIGHT EMITTING DISPLAY, AND DRIVING METHOD THEREOF

CROSS-REFERENCE TO RELATED APPLICATION

This application claims priority to and the benefit of Korean Patent Application No. 10-2010-0000570, filed on Jan. 5, 2010, in the Korean Intellectual Property Office, the entire content of which is incorporated herein by reference.

BACKGROUND

1. Field

The following description relates to a pixel circuit, an organic light emitting display, and a driving method thereof.

2. Description of Related Art

Flat displays such as Liquid Crystal Display (LCD), Plasma Display Panel (PDP) and Field Emission Display (FED) have been developed to overcome the shortcomings of a Cathode Ray Tube (CRT) display. Among these displays, an organic light emitting display is particularly of interest as a next-generation display due to its excellent light emitting efficiency, brightness, viewing angle and fast response time.

Here, an organic light emitting display displays an image by using an Organic Light Emitting Diode (OLED), which generates light by the recombination of an electron and a hole. As such, the organic light emitting display can display the image with fast response time and low power consumption.

SUMMARY OF THE INVENTION

Aspects of embodiments of the present invention are directed toward a pixel circuit for a large size organic light emitting display that is capable of solving certain issues relating the large size of the organic light emitting display by separating its initializing time, an organic light emitting display including the same, and/or a method of driving the same.

According to an embodiment of the present invention, there is provided a pixel circuit including: an organic light emitting diode; a second transistor including a gate terminal, a first terminal, and a second terminal respectively connected to a first scanning line, a data line, and a first node; a fifth transistor including a gate terminal, a first terminal, and a second terminal respectively connected to a third scanning line, the first node, and a second node; a fourth transistor including a gate terminal, a first terminal, and a second terminal respectively connected to a second scanning line, a first reference voltage, and the second node; a third transistor including a gate terminal, a first terminal, and a second terminal respectively connected to the first scanning line, a second reference voltage, and a third node; a first capacitor connected between the first node and the second node; a second capacitor connected between the second node and the third node; and a first transistor including a gate terminal, a first terminal, and a second terminal respectively connected to the first node, a first power, and the third node, and configured to drive the organic light emitting diode.

In one embodiment, the first to third scanning lines are configured to respectively and sequentially output first to third scanning signals. In one embodiment, the second scanning signal is outputted after being delayed for at least 1 horizontal time period (1H) from that of the first scanning signal, and the third scanning signal is outputted after being delayed for at least 2 horizontal time periods (2H) from that of the second scanning signal. In one embodiment, the third transistor is configured to apply a second voltage of the second reference power to the third node in response to the first scanning signal from the first scanning line. In one embodiment, the pixel circuit is configured to be driven to have: a first section where a data signal is applied from the data line, the first scanning signal and the second scanning signal have a first level, and the third scanning signal has a second level; a second section in which the first scanning signal and the third scanning signal have the second level, and the second scanning signal has the first level; and a third section having the third scanning signal at the first level, and the first scanning signal and the second scanning signal at the second level. In one embodiment, the first level is a turning-on level of the first to fifth transistors, and the second level is a turning-off level of the first to fifth transistors.

In one embodiment, the second transistor is configured to apply a data signal from the data line to the first node in response to a first scanning signal from the first scanning line.

In one embodiment, the fourth transistor is configured to apply a first voltage of the first reference power to the second node in response to a second scanning signal from the second scanning line.

In one embodiment, the fifth transistor is configured to short the first node and the second node in response to a third scanning signal from the third scanning line.

In one embodiment, the first to fifth transistors are N-type Metal Oxide Semiconductor (NMOS) transistors.

According to another embodiment of the present invention, there is provided an organic light emitting display including: a scan driving unit configured to supply scanning signals to scanning lines; a data driving unit configured to supply data signal to data lines; and pixel circuits at crossing regions of the scanning lines and the data lines, wherein each of the pixel circuits includes: an organic light emitting diode; a second transistor including a gate terminal, a first terminal, and a second terminal respectively connected to a first scanning line of the scanning lines, a data line of the data lines, and a first node; a fifth transistor including a gate terminal, a first terminal, and a second terminal respectively connected to a third scanning line of the scanning lines, the first node, and a second node; a fourth transistor including a gate terminal, a first terminal, and a second terminal respectively connected to a second scanning line of the scanning lines, a first reference voltage, and the second node; a third transistor including a gate terminal, a first terminal, and a second terminal respectively connected to the first scanning line, a second reference voltage, and a third node; a first capacitor connected between the first node and the second node; a second capacitor connected between the second node and the third node; and a first transistor including a gate terminal, a first terminal, and a second terminal respectively connected to the first node, a first power, and the third node, and configured to drive the organic light emitting diode.

In one embodiment, the scan driving unit is configured to output first to third scanning signals from the first to third scanning lines respectively, and to sequentially output the first to third scanning signals. In one embodiment, the scan driving unit is configured to output the second scanning signal after delaying it for at least 1 horizontal time period (1H) from that of the first scanning signal, and to output the third scanning signal after delaying it for at least 2 horizontal time periods (2H) from that of the seconding scanning signal. In one embodiment, the pixel circuit is driven to have: a first section where a data signal is applied from the data line, the first scanning signal and the second scanning signal have a first level, and the third scanning signal has a second level; a second section having the first scanning signal and the third scanning signal at the second level, and the second scanning signal at the first level; and a third section having the third scanning signal at the first level, and the first scanning signal and the second scanning signal at the second level. In one embodiment, the first level is a turning-on level of the first to fifth transistors, and the second level is a turning-off level of the first to fifth transistors.

According to another embodiment of the present invention, there is provided a method of driving a pixel circuit which includes: an organic light emitting diode; a second transistor including a gate terminal, a first terminal, and a second terminal respectively connected to a first scanning line, a data line, and a first node; a fifth transistor including a gate terminal, a first terminal, and a second terminal respectively connected to a third scanning line, the first node, and a second node; a fourth transistor including a gate terminal, a first terminal, and a second terminal respectively connected to a second scanning line, a first reference voltage, and the second node; a third transistor including a gate terminal, a first terminal, and a second terminal respectively connected to the first scanning line, a second reference voltage, and a third node; a first capacitor connected between the first node and the second node; a second capacitor connected between the second node and the third node; and a first transistor including a gate terminal, a first terminal, and a second terminal respectively connected to the first node, a first power, and the third node, and configured to drive the organic light emitting diode, the method including: writing data to the pixel circuit and initializing the pixel circuit by applying a data signal from the data line, and turning on the second to fourth transistors, and turning off the fifth transistor, wherein the second to fourth transistors are turned on by applying a first scanning signal to the first scanning line and a second scanning signal to the second scanning line at a first level, and the fifth transistor is turned off by applying a third scanning signal to the third scanning line at a second level; compensating for a threshold voltage of the first transistor by turning off the second transistor, the third transistor, and the fifth transistor and turning on the fourth transistor, wherein the second transistor, the third transistor, and the fifth transistor are turned off by applying the first scanning signal and the third scanning signal at the second level, and the fourth transistor is turned on by applying the second scanning signal at the first level; and lighting the organic light emitting diode by turning on the fifth transistor and turning off the second to fourth transistors, wherein the fifth transistor is turned on by applying the third scanning signal at the first level, and the second to fourth transistors are turned off by applying the first scanning signal and the second scanning signal at the second level.

In one embodiment, the first level is a turning-on level of the first to fifth transistors, and the second level is a turning-off level of the first to fifth transistors.

In one embodiment, the first to third scanning signals are sequentially applied. In one embodiment, the second scanning signal is applied after being delayed for at least 1 horizontal time period (1H) from that of the first scanning signal, and the third scanning signal is applied after being delayed for at least 2 horizontal time periods (2H) from that of the second scanning signal. In one embodiment, the first to fifth transistors are N-type Metal Oxide Semiconductor (NMOS) transistors.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
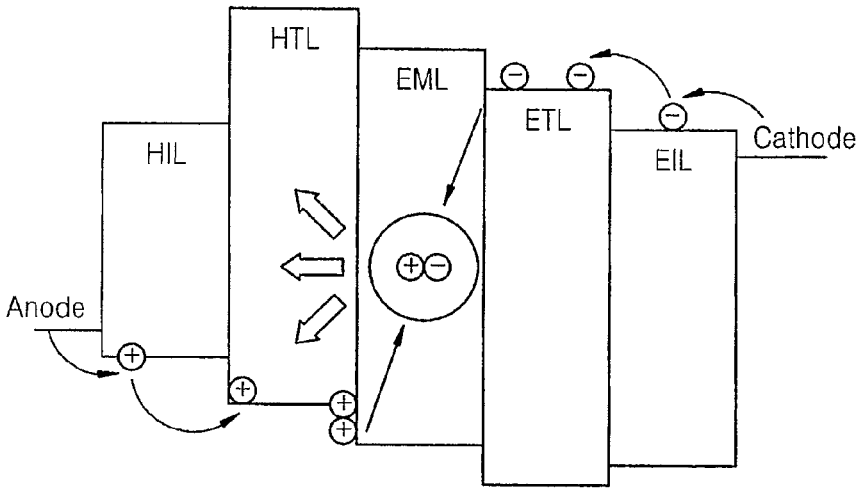
FIG. 1 is a conceptual diagram of an organic light emitting diode.

The present invention will now be described more fully with reference to the accompanying drawings, in which exemplary embodiments of the invention are shown. Like reference numerals in the drawings denote like elements.

Generally, an organic light emitting display emits light by electrically exciting a fluorescent organic compound, and is designed to display an image by driving a plurality of organic light emitting cells arranged in a matrix form with voltage or current. Since an organic light emitting cell has the properties of a diode, it is called an Organic Light Emitting Diode (OLED).

FIG. 1 is a conceptual diagram of the OLED.

Referring to FIG. 1, the OLED includes an anode (ITO), an organic thin film and a cathode (metal). In one embodiment, the organic thin film includes an Emitting Layer (EML), an Electron Transport Layer (ETL) and a Hole Transport Layer (HTL) for improving light emitting efficiency through better balancing of electrons and holes. Besides including the EML, ETL and HTL, the organic thin film may further include a Hole Injecting Layer (HIL) and/or an Election Injecting Layer (EIL).

For driving the OLED structured as described above, there are a passive matrix driving method and an active matrix driving method. The active matrix driving method uses a Thin Film Transistor (TFT) or a metal-oxide-semiconductor field-effect transistor (MOSFET). According to the passive matrix driving method, the positive and negative lines (e.g., electrode poles or electrode lines) are formed to cross each other, and a line is selected for driving. According to the active matrix driving method, the TFT is connected to each Indium Tim Oxide (ITO) pixel electrode, and the driving is performed according to a voltage maintained by a capacitor connected to a gate of the TFT. Among the kinds of active matrix driving methods, there is a voltage driving method. According to the voltage driving method, a signal is inputted for storing and/or maintaining a voltage in the capacitor, wherein the signal is also in the form of a voltage.

Figure 2:
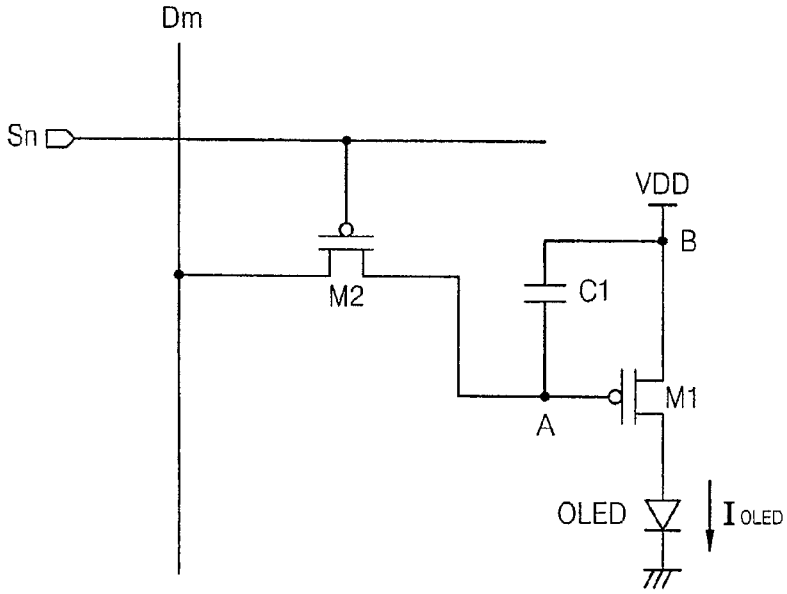
FIG. 2 is a diagram of a pixel circuit driven by a voltage driving method.

FIG. 2 is a diagram of a pixel circuit driven by the voltage driving method.

In the voltage driving method and referring to FIG. 2, a switching transistor M2 is turned on by a scanning signal of a scanning line Sn, and data voltage from a data line Dm is transferred to a gate terminal of a driving transistor M1 due to the turning-on of the switching transistor M2, and potential difference of the data voltage and a power supply voltage VDD is stored in a capacitor C1 connected between the gate and a source of the driving transistor M1. Due to the potential difference, a driving current $I_{OLED}$ flows to the OLED, and thus the OLED emits light. According to a level of the data voltage applied at this time, the OLED can display various gradations of light and shade.

However, a plurality of driving transistors M1 of a plurality of pixel circuits may have different threshold voltages. If the threshold voltage of a driving transistor M1 is different from that of another one, the amount of current outputted from each of the driving transistors of the pixel circuits is different, and thus the image may not be uniformly displayed. The threshold voltage deviation of the driving transistors M1 may become more serious as a size of the organic light emitting display is increased. This may cause degradation of picture quality of the organic light emitting display. Therefore, the threshold voltage of a driving transistor in the pixel circuit should be compensated for uniform picture quality of the organic light emitting display.

There are various circuits that can be used for compensating for the threshold voltage of the transistor in the pixel circuit. Most of these circuits perform an initializing operation and the transistor threshold voltage compensating operation concurrently or simultaneously for a set or constant period. In this case, unwanted light emission may occur during the initialization, and thus contrast ratio (C/R) may decrease. Also, as the organic light emitting display has higher resolution and larger size, the load of initialization time increases. Therefore, in the case of simultaneously performing the initialization and the driving transistor threshold voltage compensation, the time substantially required for the initialization may be relatively short. For solving this issue, a pixel circuit, which operates with separate initialization time, may be needed.

Embodiments of the present invention will now be described more fully with reference to the accompanying drawings, in which exemplary embodiments of the invention are shown. Like reference numerals in the drawings denote like elements.

Figure 3:
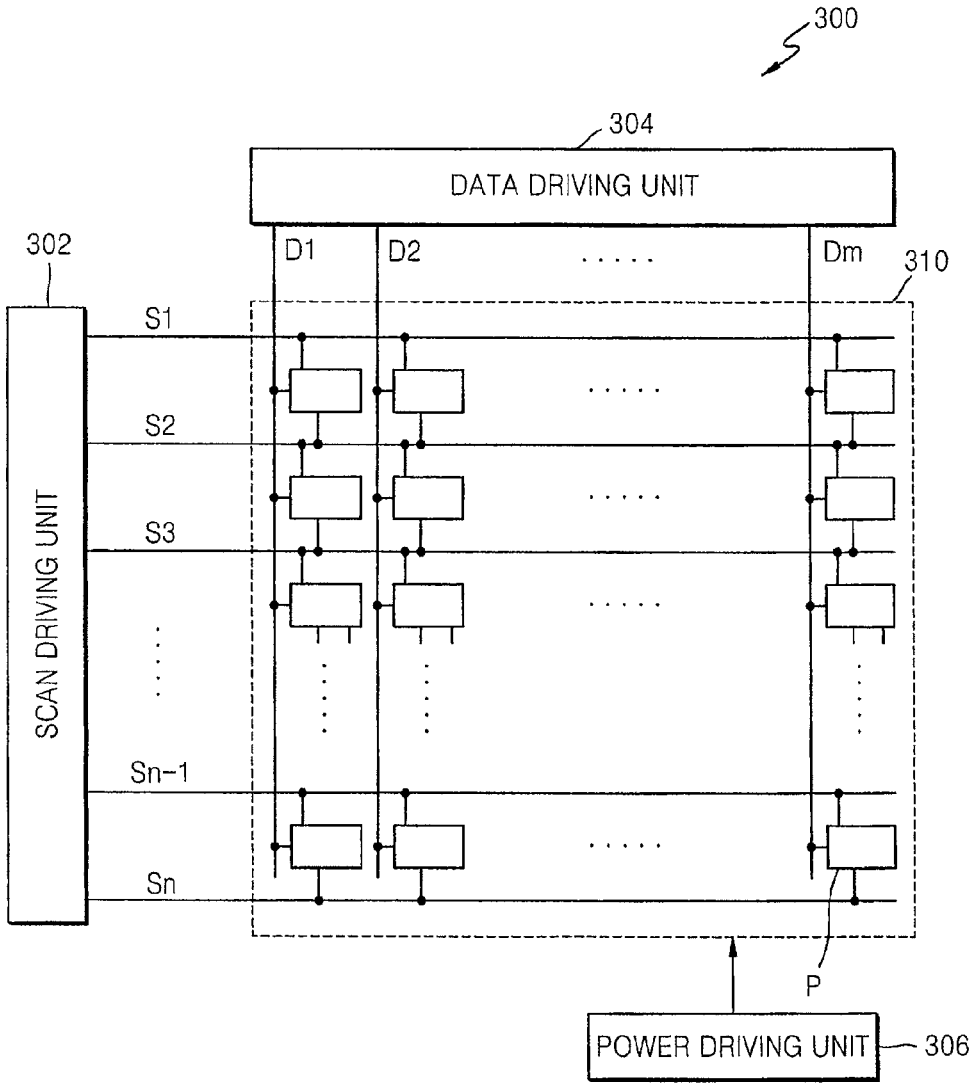
FIG. 3 is a plane view diagram illustrating an organic light emitting display according to an embodiment of the present invention.

FIG. 3 is a plane view diagram of an organic light emitting display 300 according to an embodiment of the present invention.

Referring to FIG. 3, the organic light emitting display 300 includes a pixel unit (or display region) 310, a scan driving unit 302, a data driving unit 304 and a power driving unit 306.

The pixel unit 310 includes n×m pixel circuits P, n scanning lines S1 to Sn, m data lines D1 to Dm, a first power line, and a second power line, where n and m are natural numbers. Each of the n×m pixel circuits P includes an OLED. The n scanning lines S1 to Sn are arranged in a row direction and transfer scanning signals. The m data lines D1 to Dm are arranged in a column direction and transfer data signals. The first and second power sources respectively transfer first and second power voltages ELVDD and ELVSS.

The pixel unit 310 displays an image by utilizing light emitted from the OLED with the scanning signal, the data signal, the first power voltage ELVDD of the first power source and the second power voltage ELVDD of the second power source. The scan driving unit 302 is connected to the scanning lines 51 to Sn and applies the scanning signals to the pixel unit 310.

The data driving unit 304 is connected to the data lines D1 to Dm and applies the data signals to the pixel unit 310. Here, the data driving unit 304 supplies data voltages to the n×m pixel circuits P during a programming period.

The power driving unit 306 applies the first power voltage ELVDD of the first power source and the second power voltage ELVSS of the second power source to each of the n×m pixel circuits P. Herein, the second power voltage ELVSS of the second power source may be a ground voltage (e.g., zero volt), and/or the second power source may be a ground.

Figure 4:
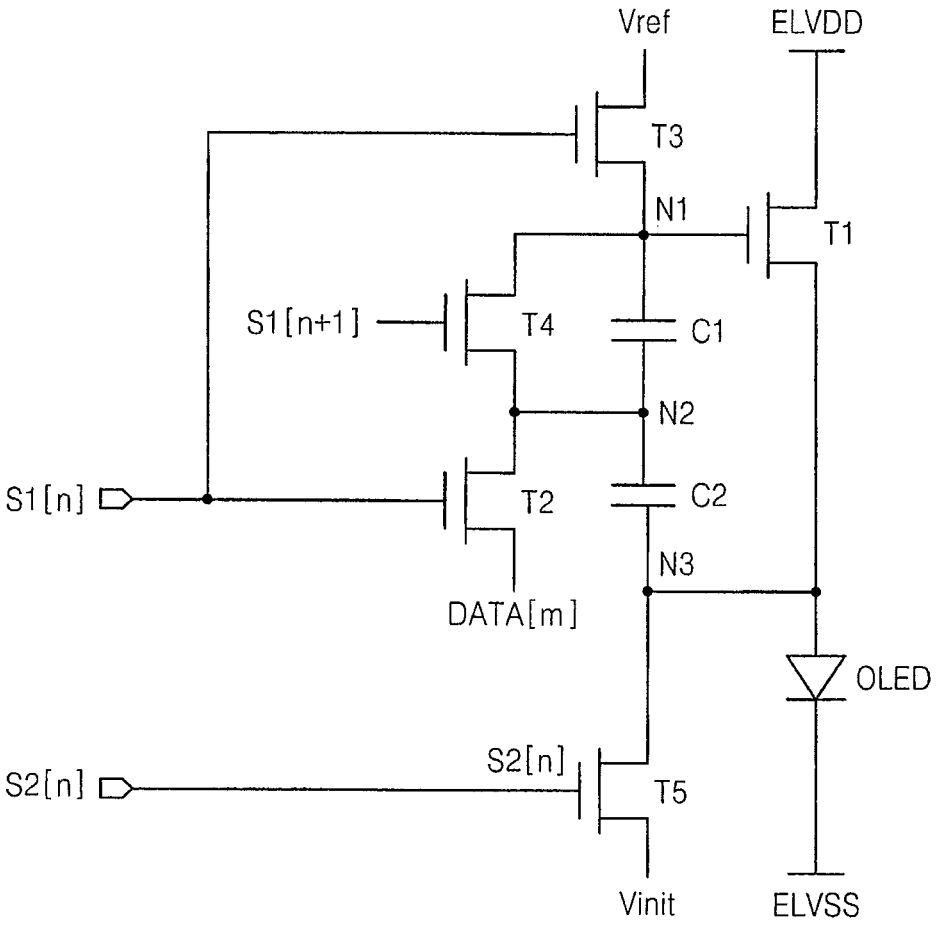
FIG. 4 is a diagram illustrating a pixel circuit illustrated in FIG. 3, according to an embodiment of the present invention.

FIG. 4 is a diagram illustrating a pixel circuit P illustrated in FIG. 3, according to an embodiment of the present invention. For convenience, FIG. 4 illustrates the pixel circuit P connected to a first nth scanning line S1[*n*], a first n+1th scanning line S1[*n*+1], a second nth scanning line S2[*n*] and a mth data line Data[m].

Referring to FIG. 4, an anode of the OLED is connected to a third node N3, and a cathode is connected to the second power source for supplying second power voltage ELVSS. In this form, the OLED generates light with a set or predetermined brightness corresponding to the amount of current supplied through a first transistor T1, i.e., a driving transistor.

A gate terminal, a drain terminal, and a source terminal of a second transistor T2 are respectively connected to the first nth scanning line S1[*n*], the data line Data[m], and a second node N2. The second transistor T2 is turned on when the second transistor T2 receives a first nth scanning signal S1[*n*]', i.e., a voltage signal of a high level, from the first nth scanning line S1[*n*], and transfers the data signal, i.e., a set or predetermined voltage signal, from the data line Data[m] to the second node N2.

A gate terminal, a drain terminal, and a source terminal of a third transistor T3 are respectively connected to the first nth scanning line S1[*n*], a first reference voltage source for supplying the first reference voltage Vref, and a first node N1. The third transistor T3 is turned on when the third transistor T3 receives the first nth scanning signal S1[*n*]', i.e., the high level voltage signal, from the first nth scanning line S1[*n*], and applies the first reference voltage Vref to the first node N1.

A gate terminal, a drain terminal, and a source terminal of a fifth transistor T5 are respectively connected to the second nth scanning line S2[*n*], a second reference voltage source for supplying the second reference voltage Vinit, and the third node N3. The fifth transistor T5 is turned on when the fifth transistor T5 receives the second nth scanning signal S2[*n*]', i.e., the high level voltage signal, from the second nth scanning line S2[*n*], and applies the voltage of the second reference voltage source Vinit to the third node N3.

A gate terminal, a drain terminal, and a source terminal of a fourth transistor T4 are respectively connected to the first n+1th scanning line S1[*n*+1], the first node N1 and the second node N2. The fourth transistor T4 is turned on when the fourth transistor T4 receives the first n+1th scanning signal S1[*n*+1]', i.e., the high level voltage signal, from the first n+1th scanning line S1[*n*+1], and shorts the first node N1 and the second node N2.

A first capacitor C1 is connected between the first node N1 and the second node N2, and a second capacitor C2 is connected between the second node N2 and the third node N3.

A gate terminal and a drain terminal of the first transistor T1 are respectively connected to the first node N1 and the first power source for supplying first power voltage ELVDD. A source terminal of the first transistor T1 is commonly connected to the third node N3 and the anode of the OLED. The first transistor T1 supplies the driving current $I_{OLED}$ to the OLED. Herein, the driving current $I_{OLED}$ is determined according to a voltage difference Vgs between the gate terminal and the source terminal of the driving transistor, i.e., the first transistor T1. When the voltage Vgs between the gate terminal and the source terminal is more than a critical voltage Vth, the first transistor T1 supplies the driving current to the OLED.

In the present embodiment of the present invention, each of the first to fifth transistors T1 to T5 is embodied with an NMOS transistor. The NMOS transistor is an N-type Metal Oxide Semiconductor that is turned off and turned on when a level state of a control signal is a low level and a high level respectively. In comparison with a PMOS transistor, the NMOS transistor has a faster operation speed, and thus is used in one embodiment for manufacturing a large screen display.

A driving process of the pixel circuit illustrated in FIG. 4 is described in more detail with reference to FIG. 5.

Figure 5:
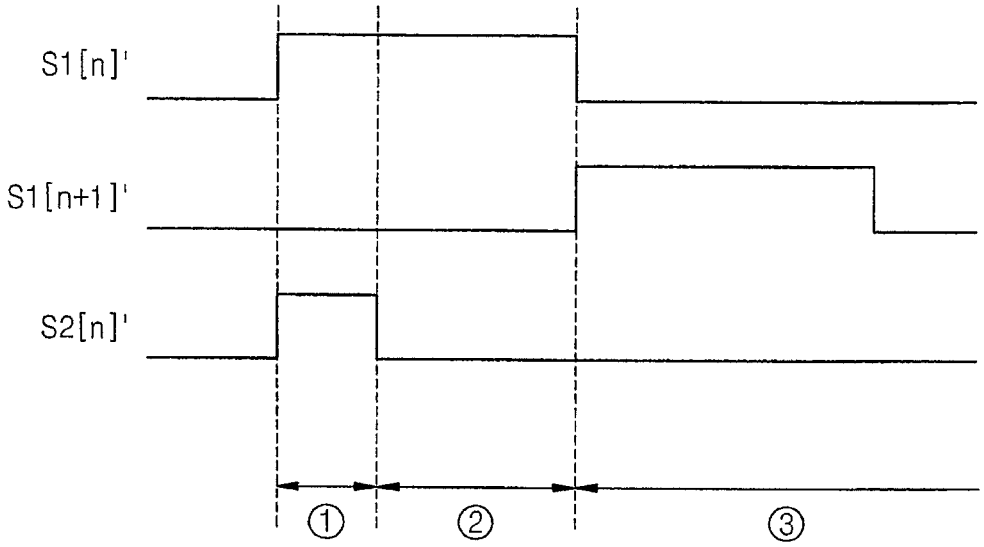
FIG. 5 is a timing diagram of the pixel circuit illustrated in FIG. 4.

Referring to FIG. 5, a first section (period) is an initialization section (period) where the first nth scanning signal S1[*n*]' of the first nth scanning line S1[*n*] and the second scanning nth signal S2[*n*]' of the second nth scanning line S2[*n*] are both at a high level, and thus the first node N1, the second node N2, and the third node N3 are initialized to the first reference voltage Vref of the first reference voltage source, the data signal Vdata, and the second reference voltage Vinit of the second reference voltage source, respectively. A second section (period) is a threshold voltage compensation section (period) for compensating the threshold voltage Vth of a data writing and driving transistor, i.e., the first transistor T1. In the second section, the first nth scanning signal S1[*n*]' remains in a high level and the second nth scanning signal S2[*n*]' transitions to a low level, and thus the data signal Vdata is stored in the first capacitor C1 and the threshold voltage Vth of the driving voltage T1 is transferred to the third node N3. A third section (period) is a light emitting section (period) where the first n+1th scanning signal S1[*n*+1]' is at a high level, and the first nth scanning signal S1[*n*]' transitions to a low level, and thus the current which corresponds to the voltage difference Vgs between the gate and the source of the driving or first transistor T1, i.e., the driving current $I_{OLED}$, is supplied to the OLED so that the OLED emits light.

Referring to FIGS. 4 and 5, the switching operation and driving operation of the transistors in each section are described in more detail.

In the first section, as the data signal is applied, and if the first nth scanning signal S1[*n*]' and the second nth scanning signal S2[*n*]' are in a high level, the second transistor T2, the third transistor T3, and the fifth transistor T5 are turned on, and thus the second node N2, the first node N1, and the third node N3 are respectively initialized to the data signal Vdata, the first reference voltage Vref, and the second reference voltage Vinit.

In the second section, as the data signal is applied, and if the first nth scanning signal S1[*n*]' remains in a high level and the second nth scanning signal S2[*n*]' transitions to a low level, the fifth transistor T5 is turned on, and thus the threshold voltage Vth of the first transistor T1 is transferred to the third node N3. Herein, the voltage difference Vgs between the gate terminal and the source terminal of the driving transistor T1 is Vdata−Vref+Vth. Herein, the first reference voltage Vref is a low voltage so that a current does not flow to the OLED, and the second reference voltage Vinit is sufficiently lower voltage than Vref-Vth. Accordingly, the above-mentioned voltages are in the range of ELVDD>Vdata>Vref>Vinit.

In the third section, when the first nth+1 scanning signal S[n+1]' is applied, the fourth transistor T4 is turned on, and the first node N1 and the second node N2 are short-circuited, and a higher voltage than the threshold voltage Vth of the driving transistor, i.e., the first transistor T1, is applied so that the first transistor T1 is turned on. The driving current $I_{OLED}$ which flows to the OLED is determined according to a following Equation.

$$I_{OLED}=K(V_{gs}-V_{th})^2 \quad \text{Equation 1}$$

where, K is a constant value determined by the mobility and parasitic capacitance of the driving transistor, and Vgs is the voltage difference between the gate terminal and the source terminal of the driving or first transistor T1, and the Vth is the threshold voltage of the driving or first transistor T1. Herein, the Vgs is a voltage difference between the first node N1 and the third node N3, i.e., the voltage difference between the gate terminal and the source terminal of the first transistor T1.

By applying the previously mentioned value of the Vgs to Equation 1, Equation 2 is obtained.

$$I_{OLED}=K(V_{data}-V_{ref}+V_{th}-V_{th})^2$$

$$I_{OLED}=K(V_{data}-V_{ref})^2 \quad \text{Equation 2}$$

Through Equation 2, it may be ascertained that the driving current $I_{OLED}$ which flows to the OLED is determined by the reference voltage Vref and the data voltage Vdata. That is, it may be ascertained that the driving current $I_{OLED}$ flows regardless of the threshold voltage Vth of the driving transistor, i.e., the first transistor T1.

Figure 6:
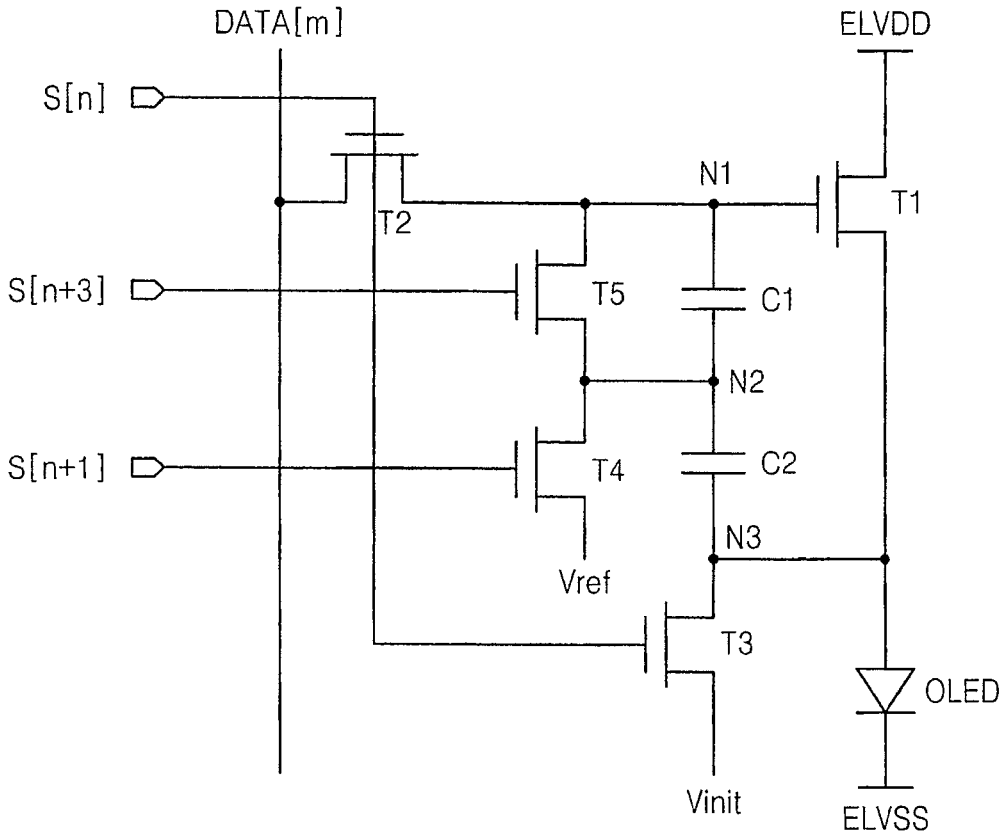
FIG. 6 is a diagram illustrating the pixel circuit illustrated in FIG. 3, according to another embodiment of the present invention.

FIG. 6 is a diagram illustrating a pixel circuit P illustrated in FIG. 3, according to another embodiment of the present invention.

In FIG. 6, for convenience, sequentially delayed and outputted scanning lines from Nth scanning line are respectively illustrated as a first scanning line S[n], a second scanning line S[n+1] and a third scanning line S[n+3], and the pixel circuit is connected to an Mth data line Data[m].

Referring to FIG. 6, an anode of the OLED is commonly connected to a third node N3 and a source terminal of a first transistor T1, and a cathode is connected to a second power source for supplying a second power voltage ELVSS. In this form, the OLED generates light with a set or predetermined brightness corresponding to the amount of current supplied through the first transistor T1, i.e., a driving transistor.

A gate terminal, a drain terminal, and a source terminal of a second transistor T2 are respectively connected to the first scanning line S[n], the data line Data[m] and a first node N1. The second transistor T2 is turned on when the second transistor T2 receives a first scanning signal, i.e., a high level signal, from the first scanning line S[n], and transfers a data signal to the first node N1.

A gate terminal, a source terminal, and a drain terminal of a fourth transistor T4 are respectively connected to the second scanning line S[n+1], a second node N2, and a first reference voltage source for supplying a first reference voltage Vref. The fourth transistor T4 is turned on when the fourth transistor T4 receives a second scanning signal, i.e., a high level signal, from the second scanning line S[n+1], and applies the first reference voltage Vref to the second node N2.

A gate terminal, a drain terminal, and a source terminal of a third transistor T3 are respectively connected to the first scanning line S[n], a second reference voltage source for supplying a second reference voltage Vinit, and the third node N3. The third transistor T3 is turned on when the third transistor T3 receives the first scanning signal, i.e., the high level signal, from the first scanning line S[n], and applies the second reference voltage Vinit to the third node N3.

A gate terminal, a drain terminal, and a source terminal of a fifth transistor T5 are respectively connected to the third scanning line S[n+3], the first node N1, and the second node N2. The fifth transistor T5 is turned on when the fifth transistor T5 receives a third scanning signal, i.e., a high level signal, from the third scanning line S[n+3], and shorts the first node N1 and the second node N2.

A first capacitor C1 is connected between the first node N1 and the second node N2, and a second capacitor C2 is connected between the second node N2 and the third node N3. The first capacitor C2 maintains a voltage between the first node N1 and the second node N2, and the second capacitor C2 maintains a voltage between the second node N2 and the third node N3.

A gate terminal, a drain terminal, and a source terminal of the first transistor T1 are respectively connected to the first node N1, a first power source for supplying a first power voltage ELVDD and the third node N3. When a voltage Vgs between the gate terminal and the source terminal is over a threshold voltage, the first transistor T1 transfers a driving current $I_{OLED}$ for driving the OLED.

In the present embodiment of the present invention, each of the first to fifth transistors T1 to T5 is embodied with an NMOS transistor. The NMOS transistor is an N-type Metal Oxide Semiconductor that is turned off and turned on when a level state of a control signal is a low level and a high level respectively. In comparison with a PMOS transistor, the NMOS transistor has a faster operation speed, and thus is used in one embodiment for manufacturing a large screen display.

A driving process of the pixel circuit illustrated in FIG. 6 is described in more detail with reference to FIG. 7.

Figure 7:
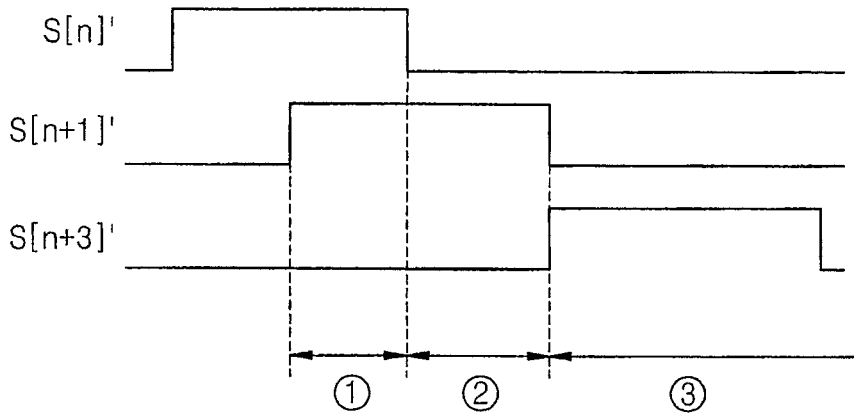
FIG. 7 is a timing diagram of the pixel circuit illustrated in FIG. 6.

Referring to FIG. 7, the first scanning signal S[n]', the second scanning signal S[n+1]', and the third scanning signal S[n+3]' are outputted after being delayed from one of the scanning lines S1 to Sn outputted from the scan driving unit 302. Herein, the second scanning signal S[n+1]' is delayed for a delay amount of 1 horizontal time period 1H to be outputted on the basis of the first scanning signal S[n]', and the third scanning signal S[n+3]' is delayed for a delay amount of 2 horizontal time periods 2H to be outputted on the basis of the second scanning signal S[n+1]'.

As illustrated in FIG. 7, according to a data signal Vdata applied at one horizontal period, the first to third scanning signals which have a length of 2 horizontal periods are applied. In a section of the first scanning signal S[n]' and the second scanning signal S[n+1]', which is delayed for 1 horizontal period and then outputted, overlap in a high level, i.e., in a first section, data writing and initializing operations are performed. Also, a section where the first scanning signal S[n]' transitions to a low level and the second scanning signal S[n+1]', which is delayed for 1 horizontal period and then outputted, remains in a high level, i.e., a threshold voltage compensation section, is performed for one horizontal time period 1H. Accordingly, by increasing a high level maintaining section of the scanning signal to be more than two horizontal time periods 2H, the threshold voltage compensation section may be increased to be more than one horizontal time period 1H. Therefore, in the case of driving the pixel circuit at a high speed, the effect of the threshold voltage compensation may be increased or maximized.

Referring to FIG. 7 again, the first section is a data write and initialization section. In the first section, if a valid data signal is applied from the data line Data[m] and the first scanning signal S[n]' and the second scanning signal S[n+1]' are applied in a high level, the second transistor T2, the third transistor T3, and the fourth transistor T4 are turned on. If the first scanning signal S[n]' is applied in a high level, the second transistor T2 is turned on, and thus the data signal Vdata is transferred to the first node N1, and the third transistor T3 is turned on so that voltage of the second reference voltage Vinit is applied to the third node N3. Also, as the second scanning signal S[n+1]' is applied in a high level, the voltage of the first reference voltage Vref is applied to the second node N2. Accordingly, the first to third nodes N1 to N3 are respectively initialized to the data signal Vdata, the voltage of the first reference voltage Vref, and the voltage of the second reference voltage Vinit.

A second section is the threshold voltage compensation section for compensating a threshold voltage Vth, where the second scanning signal S[n+1]' remains in a high level and the first scanning signal S[n]' transitions to a low level. The fourth transistor T4 remains in a turned-on state, and the second and the third transistors T2 and T3 are turned off. Voltages of the first and the second nodes N1 and N2 do not change, and they remain as the previously applied voltages Vdata and Vref. According to the turning off of the fifth transistor T5, the voltage of the third node N3 is increased from Vinit to Vdata−Vth.

A third section is a light emitting section where if the third scanning signal S[n+3]' transitions to a high level and the first and the second scanning signals are applied in a low level, all of the second to the fourth transistors T2 to T4 are turned off and the fifth transistor T5 is turned on. In this section, the fourth transistor T4 is turned off, and thus the first node N1 and the second node N2 are short-circuited, and the voltage difference between the gate terminal and the source terminal of the first transistor T1, i.e., the Vgs, is made to be Vref−Vdata+Vth and stored into the second capacitor C2. Also, since the Vgs of the driving transistor T1 increases over the threshold voltage, the driving current $I_{OLED}$ flows to the OLED.

By applying the previously mentioned value of the Vgs to Equation 1, the driving current $I_{OLED}$ is represented as the following Equation 3.

$$I_{OLED}=K(V_{ref}-V_{data})^2 \quad \text{Equation 3}$$

Through Equation 3, it may be ascertained that the driving current $I_{OLED}$ which flows to the OLED is determined by the reference voltage Vref and the data voltage Vdata. That is, it may be ascertained that the driving current $I_{OLED}$ flows regardless of the threshold voltage Vth of the driving transistor, i.e., the first transistor T1.

Also, unlike the pixel circuit illustrated in FIGS. 4 and 5, the pixel circuit illustrated in FIGS. 6 and 7 performs the initialization with the threshold voltage compensation operation. Accordingly, when a large-sized panel with a high resolution is driven, the shortcoming of insufficient threshold voltage compensation time due to the shortened scanning time may be overcome. This shortcoming causes degradation of threshold voltage compensation performance, and results in non-uniform brightness. Also, by using only one scanning line, e.g., S1[*n*] for driving one pixel circuit, a structure of a gate driver is simple, and the scanning signal may be supplied at both sides of the panel without using a light emitting driver, and thus the structure is useful for realizing a large-sized panel in view of RC delay.

Figure 8:
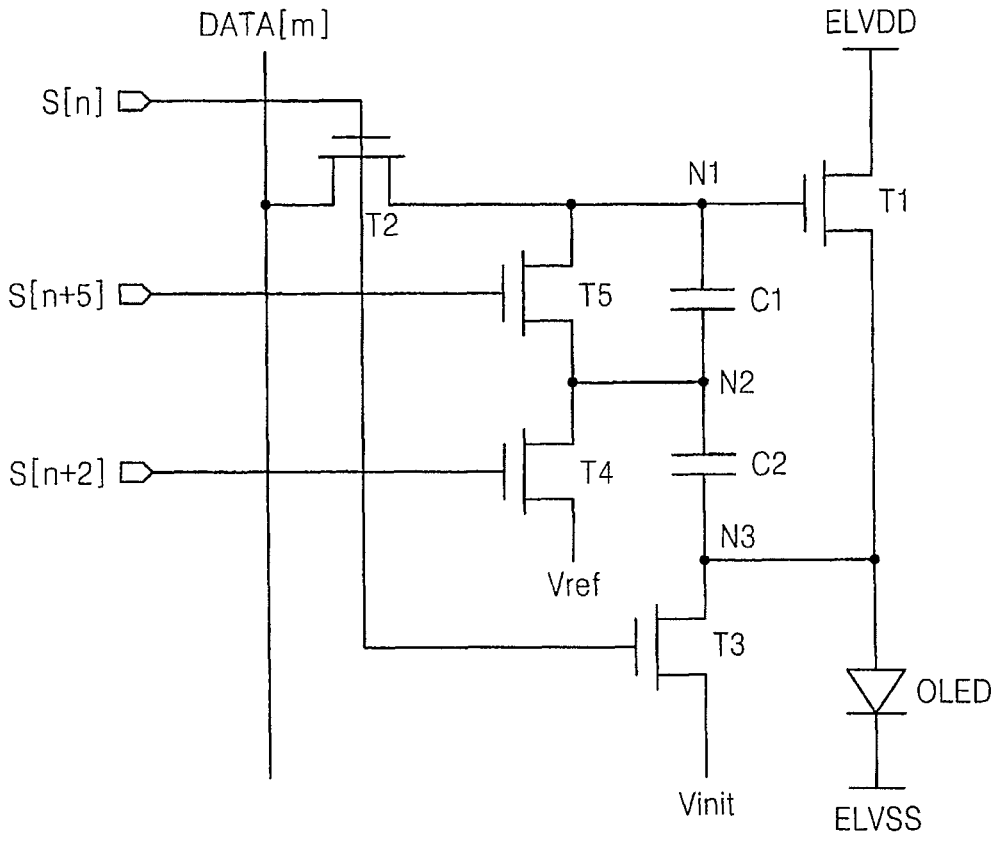
FIG. 8 is a diagram illustrating the pixel circuit illustrated in FIG. 3, according to another embodiment of the present invention.

FIG. 8 is a diagram illustrating the pixel circuit P illustrated in FIG. 3, according to another embodiment of the present invention.

In FIG. 8, for convenience, sequentially delayed and outputted scanning lines from the Nth scanning line are respectively illustrated as a first scanning line S[n], a second scanning line S[n+2] and a third scanning line S[n+5], and the pixel circuit P is connected to an Mth data line Data[m].

In comparison with the pixel circuit P illustrated in FIG. 6, for being served as the second scanning signal from the second scanning line S[n+2] is used instead of S[n+1], and for being served as the third scanning signal from the third scanning line S[n+5] is used instead of S[n+3]. Herein, the second scanning signal S[n+2]' is delayed for a delay amount of 2 horizontal time periods 2H to be outputted on the basis of the first scanning signal S[n]', and the third scanning signal S[n+5]' is delayed for a delay amount of 3 horizontal time periods 3H to be outputted on the basis of the second scanning signal S[n+2]'.

Referring to FIG. 8, an anode of the OLED is commonly connected to a third node N3 and a source terminal of a first transistor T1, and a cathode is connected to a second power source for supplying a second power voltage ELVSS. In this form, the OLED generates light with a set or predetermined brightness corresponding to the amount of current supplied through the first transistor T1, i.e., a driving transistor.

A gate terminal, a drain terminal, and a source terminal of a second transistor T2 are respectively connected to the first scanning line S[n], the data line Data[m], and a first node N1. The second transistor T2 is turned on when the second transistor T2 receives a first scanning signal S[n]', i.e., a high level signal, from the first scanning line S[n], and transfers a data signal to the first node N1.

A gate terminal, a source terminal, and a drain terminal of a fourth transistor T4 are respectively connected to the second scanning line S[n+2], a second node N2, and a first reference voltage Vref. The fourth transistor T4 is turned on when the fourth transistor T4 receives a second scanning signal S[n+2]', i.e., a high level signal, from the second scanning line S[n+2], and applies the first reference voltage Vref to the second node N2.

A gate terminal, a drain terminal, and a source terminal of a third transistor T3 are respectively connected to the first scanning line S[n], a second reference voltage Vinit, and the third node N3. The third transistor T3 is turned on when the third transistor T3 receives the first scanning signal S[n]', i.e., the high level signal, from the first scanning line S[n], and applies the second reference voltage Vinit to the third node N3.

A gate terminal, a drain terminal, and a source terminal of a fifth transistor T5 are respectively connected to the third scanning line S[n+5], the first node N1, and the second node N2. The fifth transistor T5 is turned on when the fifth transistor T5 receives a third scanning signal S[n+5]', i.e., a high level signal, from the third scanning line S[n+5], and shorts the first node N1 and the second node N2.

A first capacitor C1 is connected between the first node N1 and the second node N2, and a second capacitor C2 is connected between the second node N2 and the third node N3. The first capacitor C2 maintains a voltage between the first node N1 and the second node N2, and the second capacitor C2 maintains a voltage between the second node N2 and the third node N3.

The gate terminal, a drain terminal, and the source terminal of the first transistor T1 are respectively connected to the first node N1, a first power source for supplying a first power voltage ELVDD, and the third node N3. When a voltage Vgs between the gate terminal and the source terminal is over a threshold voltage, the first transistor T1 transfers a driving current $I_{OLED}$ for driving the OLED.

In the present embodiment of the present invention, each of the first to fifth transistors T1 to T5 is embodied with an NMOS transistor. The NMOS transistor is an N-type Metal Oxide Semiconductor that is turned off and turned on when a level state of a control signal is a low level and a high level respectively. In comparison with a PMOS transistor, the NMOS transistor has a faster operation speed, and thus is favorably used for manufacturing a large screen display.

Figure 9:
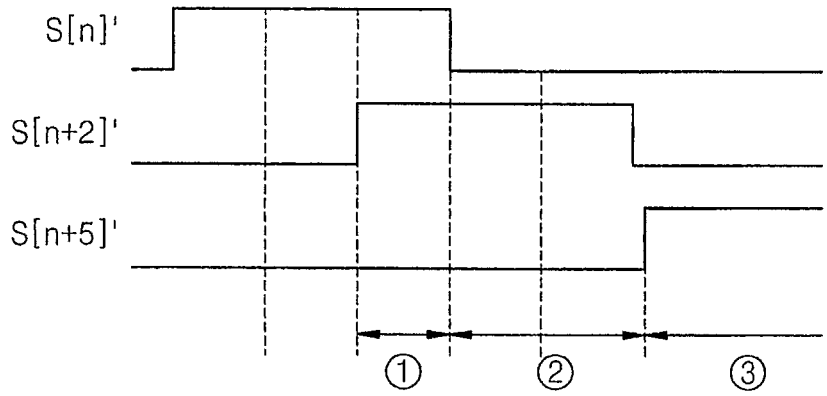
FIG. 9 is a timing diagram of the pixel circuit illustrated in FIG. 8.

FIG. 9 is a timing diagram illustrating a driving process of the pixel circuit P illustrated in FIG. 8. Referring to FIG. 9, the driving process is described focusing on a difference from the timing diagram of the driving process of FIG. 7.

Referring to FIG. 9, the first scanning signal S[n]', the second scanning signal S[n+2]' and the third scanning signal S[n+5]' are outputted after being delayed from one of the scanning lines S1 to Sn outputted from the scan driving unit 302.

As illustrated in FIG. 9, according to a data signal Vdata applied at one horizontal period, the first to third scanning signals which have a length of 3 horizontal periods are applied. In a section where the first scanning signal S[n]' and the second scanning signal S[n+2]', which is delayed for 2 horizontal periods and then outputted, overlap in a high level, i.e., in a first section, data writing and initializing operations are performed. Also, a section where the first scanning signal S[n]' transitions to a low level and the second scanning signal S[n+2]', which is delayed for 2 horizontal periods and then outputted, remains in a high level, i.e., a threshold voltage compensation section, is performed for 2 horizontal periods 2H. Accordingly, by increasing a high level maintaining section of the scanning signal to be more than 2 horizontal periods 2H, the threshold voltage compensation section may be increased to be more than 2 horizontal periods 2H. Therefore, in the case of driving the pixel circuit P at a high speed, the effect of the threshold voltage compensation may be maximized.

In the above-described embodiment, although the high level maintaining period of the scanning signal is 3 horizontal time periods 3H, and the second and the third scanning signals are respectively delayed for 2 horizontal time periods 2H and 3 horizontal time periods 3H to be outputted, as a matter of course, the embodiment is not limited by this and may be realized by increasing the high level maintaining period of the scanning signal. Also, although the detailed specification and the drawings have been limited to an NMOS transistor, they may be applicable to the case of using a PMOS transistor (PMOS-inverted OLED structure).

According to the embodiment of the present invention, the problems due to increasing the size and resolution of an organic light emitting display can be solved by separating the initialization section and the threshold voltage compensation section, and the threshold voltage of the driving transistor is compensated for so that an image with a uniform brightness can be displayed.

Also, driving the pixel circuit with only the scanning signal is advantageous for driving a large-sized display. Since the threshold voltage compensation time can be increased by adjusting a length of the scanning signal, the effect of the threshold voltage compensation can be increased or maximized at high speed driving.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel circuit comprising:

an organic light emitting diode;

a second transistor comprising a gate terminal, a first terminal, and a second terminal respectively connected to a first scanning line, a data line, and a first node;

a fifth transistor comprising a gate terminal, a first terminal, and a second terminal respectively connected to a third scanning line, the first node, and a second node, the first terminal being directly connected to the first node;

a fourth transistor comprising a gate terminal, a first terminal, and a second terminal respectively connected to a second scanning line, a first reference voltage, and the second node, the second terminal being directly connected to the second node, and the second scanning line being different from the third scanning line;

a third transistor comprising a gate terminal, a first terminal, and a second terminal respectively connected to the first scanning line, a second reference voltage, and a third node;

a first capacitor connected between the first node and the second node;

a second capacitor connected between the second node and the third node; and a first transistor comprising a gate terminal, a first terminal, and a second terminal respectively connected to the first node, a first power, and the third node, and configured to drive the organic light emitting diode comprising a first terminal connected to the third node, and a second terminal connected to a second power, the second power being different from the second reference voltage.

2. The pixel circuit of claim 1, wherein the first to third scanning lines are configured to respectively and sequentially output first to third scanning signals.

3. The pixel circuit of claim 2, wherein the second scanning signal is outputted after being delayed for at least 1 horizontal time period (1H) from that of the first scanning signal, and the third scanning signal is outputted after being delayed for at least 2 horizontal time periods (2H) from that of the second scanning signal.

4. The pixel circuit of claim 2, wherein the third transistor is configured to apply the second reference voltage to the third node in response to the first scanning signal from the first scanning line.

5. The pixel circuit of claim 1, wherein the pixel circuit is configured to be driven to have:

a first section where a data signal is applied from the data line, a first scanning signal and a second scanning signal have a first level, and a third scanning signal has a second level;

a second section in which the first scanning signal and the third scanning signal have the second level, and the second scanning signal has the first level; and a third section having the third scanning signal at the first level, and the first scanning signal and the second scanning signal at the second level and, the first level is a turning-on level of the first to fifth transistors, and the second level is a turning-off level of the first to fifth transistors.

6. The pixel circuit of claim 1, wherein the pixel circuit is configured to be driven to have:

a first section where a data signal is applied from the data line, and the second node and the third node are initialized by turning on the third transistor and the fourth transistor in response to a first scanning signal from the first scanning line and a second scanning signal from the second scanning line;

a second section where a threshold voltage of the first transistor is compensated by turning on the fourth transistor in response to the second scanning signal from the second scanning line; and a third section where the organic light emitting diode lights by turning on the fifth transistor in response to a third scanning signal from the third scanning line.

7. The pixel circuit of claim 1, wherein the second transistor is configured to apply a data signal from the data line to the first node in response to a first scanning signal from the first scanning line.

8. The pixel circuit of claim 1, wherein the fourth transistor is configured to apply the first reference voltage to the second node in response to a second scanning signal from the second scanning line.

9. The pixel circuit of claim 1, wherein the fifth transistor in configured to short the first node and the second node in response to a third scanning signal from the third scanning line.

10. The pixel circuit of claim 1, wherein the first to fifth transistors are N-type Metal Oxide Semiconductor (NMOS) transistors.

11. An organic light emitting display comprising:

a scan driving unit configured to supply scanning signals to scanning lines;

a data driving unit configured to supply data signal to data lines; and pixel circuits at crossing regions of the scanning lines and the data lines, wherein each of the pixel circuits comprises:

an organic light emitting diode;

a second transistor comprising a gate terminal, a first terminal, and a second terminal respectively connected to a first scanning line of the scanning lines, a data line of the data lines, and a first node;

a fifth transistor comprising a gate terminal, a first terminal, and a second terminal respectively connected to a third scanning line of the scanning lines, the first node, and a second node, the first terminal being directly connected to the first node;

a fourth transistor comprising a gate terminal, a first terminal, and a second terminal respectively connected to a second scanning line of the scanning lines, a first reference voltage, and the second node, the second terminal being directly connected to the second node, and the second scanning line being different from the third scanning line;

a third transistor comprising a gate terminal, a first terminal, and a second terminal respectively connected to the first scanning line, a second reference voltage, and a third node;

a first capacitor connected between the first node and the second node;

a second capacitor connected between the second node and the third node; and a first transistor comprising a gate terminal, a first terminal, and a second terminal respectively connected to the first node, a first power, and the third node, and configured to drive the organic light emitting diode comprising a first terminal connected to the third node, and a second terminal connected to a second power, the second power being different from the second reference voltage.

12. The organic light emitting display of claim 11, wherein the scan driving unit is configured to output first to third scanning signals from the first to third scanning lines respectively, and to sequentially output the first to third scanning signals.

13. The organic light emitting display of claim 12, wherein the scan driving unit is configured to output the second scanning signal after delaying it for at least 1 horizontal time period (1H) from that of the first scanning signal, and to output the third scanning signal after delaying it for at least 2 horizontal time periods (2H) from that of the seconding scanning signal.

14. The organic light emitting display of claim 12, wherein the pixel circuit is driven to have:

a first section where a data signal is applied from the data line, the first scanning signal and the second scanning signal have a first level, and the third scanning signal has a second level;

a second section having the first scanning signal and the third scanning signal at the second level, and the second scanning signal at the first level; and a third section having the third scanning signal at the first level, and the first scanning signal and the second scanning signal at the second level.

15. The organic light emitting display of claim 14, wherein the first level is a turning-on level of the first to fifth transistors, and the second level is a turning-off level of the first to fifth transistors.

16. A method of driving a pixel circuit which comprises:

an organic light emitting diode;

a second transistor comprising a gate terminal, a first terminal, and a second terminal respectively connected to a first scanning line, a data line, and a first node;

a fifth transistor comprising a gate terminal, a first terminal, and a second terminal respectively connected to a third scanning line, the first node, and a second node;

a fourth transistor comprising a gate terminal, a first terminal, and a second terminal respectively connected to a second scanning line, a first reference voltage, and the second node;

a third transistor comprising a gate terminal, a first terminal, and a second terminal respectively connected to the first scanning line, a second reference voltage, and a third node;

a first capacitor connected between the first node and the second node;

a second capacitor connected between the second node and the third node; and a first transistor comprising a gate terminal, a first terminal, and a second terminal respectively connected to the first node, a first power, and the third node, and configured to drive the organic light emitting diode, the method comprising:

writing data to the pixel circuit by applying a data signal from the data line to the first node and initializing the pixel circuit by applying the second reference voltage to the third node, wherein the second to fourth transistors are turned on by applying a first scanning signal to the first scanning line and a second scanning signal to the second scanning line at a first level, and the fifth transistor is turned off by applying a third scanning signal to the third scanning line at a second level;

compensating for a threshold voltage of the first transistor by turning off the second transistor, the third transistor, and the fifth transistor and turning on the fourth transistor, wherein the second transistor, the third transistor, and the fifth transistor are turned off by applying the first scanning signal and the third scanning signal at the second level, and the fourth transistor is turned on by applying the second scanning signal at the first level; and lighting the organic light emitting diode by turning on the fifth transistor and turning off the second to fourth transistors, wherein the fifth transistor is turned on by applying the third scanning signal at the first level, and the second to fourth transistors are turned off by applying the first scanning signal and the second scanning signal at the second level.

17. The method of claim 16, wherein the first level is a turning-on level of the first to fifth transistors, and the second level is a turning-off level of the first to fifth transistors.

18. The method of claim 16, wherein the first to third scanning signals are sequentially applied.

19. The method of claim 18, wherein the second scanning signal is applied after being delayed for at least 1 horizontal time period (1H) from that of the first scanning signal, and the third scanning signal is applied after being delayed for at least 2 horizontal time periods (2H) from that of the second scanning signal.

20. The method of claim 16, wherein the first to fifth transistors are N-type Metal Oxide Semiconductor (NMOS) transistors.

21. The method of claim 16, wherein a length of the first to third scanning signals controls a length of the compensating for the threshold voltage of the first transistor.

* * * * *